US007785447B2

(12) United States Patent
Eatough et al.

(10) Patent No.: US 7,785,447 B2
(45) Date of Patent: Aug. 31, 2010

(54) CLEAN PRODUCTION OF COKE

(75) Inventors: Craig N. Eatough, Provo, UT (US); Jon S. Heaton, Provo, UT (US); Steven R. Eatough, Provo, UT (US)

(73) Assignee: Combustion Resources, LLC, Provo, UT (US)

( * ) Notice: Subject to any disclaimer, the term of this patent is extended or adjusted under 35 U.S.C. 154(b) by 81 days.

(21) Appl. No.: 11/999,160

(22) Filed: Dec. 3, 2007

(65) Prior Publication Data

US 2008/0116052 A1 May 22, 2008

Related U.S. Application Data

(63) Continuation of application No. 09/954,603, filed on Sep. 17, 2001, now abandoned.

(51) Int. Cl.
*C10B 53/00* (2006.01)
*C01B 31/00* (2006.01)

(52) U.S. Cl. ..... 201/6; 201/9; 201/34; 201/39; 264/29.1; 264/29.4; 264/29.5

(58) Field of Classification Search ..... 201/6, 201/9, 34, 39, 95, 120, 124, 108, 227, 228; 44/553; 264/29.1, 29.5, 29.4
See application file for complete search history.

(56) References Cited

U.S. PATENT DOCUMENTS 1,912,002 A * 5/1933 Loebell ..... 44/568
4,105,501 A * 8/1978 Suzuki et al. ..... 201/6
4,127,391 A * 11/1978 Koppelman ..... 44/282
4,164,467 A 8/1979 Liller
4,197,160 A * 4/1980 Degrave et al. ..... 201/6
4,314,887 A * 2/1982 Haley et al. ..... 202/91
4,352,720 A * 10/1982 Weber et al. ..... 202/124
4,530,752 A 7/1985 Deering et al.
5,752,993 A * 5/1998 Eatough et al. ..... 44/553
6,043,289 A 3/2000 Nicaud et al.

FOREIGN PATENT DOCUMENTS

EP 32412 * 7/1981

OTHER PUBLICATIONS

Machine Translation EP 0032412—Abstract, Description, Claims from internet esp@cenet.*

* cited by examiner

*Primary Examiner*—N. Bhat
(74) *Attorney, Agent, or Firm*—TraskBritt

(57) ABSTRACT

Closed apparatus and processes by which carbon feedstock is composed of a mixture of non-coking coal fines and another carbonaceous material, such as waste coke fines, are described. The coal and coke fines are mixed together and may be formed into solid pieces. The mixture alone or as solid pieces is fired through pyrolyzation into solid pieces of coke, with solid and gaseous by-products of pyrolyzation being recycled for use within the coke-producing closed system, thereby reducing or eliminating release of undesirable substances to the environment. A char-forming binder may or may not be added to the carbon mixture prior to pyrolyzation.

47 Claims, 1 Drawing Sheet

CLEAN PRODUCTION OF COKE

CROSS-REFERENCE TO RELATED APPLICATION

This application is a continuation of U.S. patent application Ser. No. 09/954,603, filed Sep. 17, 2001, now abandoned, the disclosure of which is hereby incorporated herein by this reference.

Incorporated by reference is patent application Ser. No. 10/666,419 filed Sep. 19, 2003, now abandoned, which is a continuation in part of U.S. patent Ser. No. 09/954,603. Incorporated by reference is U.S. patent application Ser. No. 10/691,339, filed Oct. 22, 2003, now abandonded is a continuation of U.S. Ser. No. 09/954,603. In corporated by reference is PCT/US02/02839 which is a continuation of U.S. application Ser. No. 09/954,603. The disclosures of which are hereby incorporated herein by this reference.

FIELD OF THE INVENTION

The present invention relates generally to clean production of coke and, more particularly, to the use of two types of carbon, one of which comprises low-quality coal fines, such as waste coal fines, and/or waste coke or char fines, which, after mixing, may be fired without formation into objects or formed into objects and fired to produce solid pyrolyzed objects or pieces, with by-products from pyrolyzation being recycled for use within the coke-producing closed system.

BACKGROUND

Coke heretofore has conventionally been produced from high-quality sources of carbon, such as high-quality coking coals. Prior processes and apparatus for conventionally producing coke typically are open or partly open systems, which generate by-products released to pollute the atmosphere.

BRIEF SUMMARY OF THE INVENTION

In brief summary, the present invention overcomes, or substantially alleviates, problems associated with prior ways of conventionally producing coke. The present invention may be summarized as comprising closed-system apparatus and processes by which carbon feedstock, comprised of a mixture of non-coking coal and/or another carbonaceous material, such as waste coke fines, are mixed together and pyrolyzed into coke, either as solid pieces or not. When solid pieces or objects of the mixture are formed, they are fired through pyrolyzation into solid pieces of coke, with solid and/or liquid and gaseous by-products of pyrolyzation being recycled for use within the closed coke-producing system, thereby eliminating release of undesirable substances to the atmosphere. Feedback tars, with or without a char-forming binder, is added to the carbon mixture prior to pyrolyzation.

With the foregoing in mind, it is a primary object of the present invention to overcome, or substantially alleviate, problems of the past associated with production of coke.

Another paramount object of the present invention is to produce a novel form of coke and to do so using novel apparatus and unique processes.

A further dominant object is to produce coke from a mixture comprising low-quality or non-coking coal fines, which mixture is pyrolyzed into high-quality coke.

Another important object is to produce coke from a mixture comprising waste coke fines, which mixture is pyrolyzed into high-quality coke.

An additional object of importance is to produce coke so as to avoid contaminating the environment by recycling or recirculating solid and/or liquid and gaseous by-products within the closed coke-producing system.

These and other objects and features of the present invention will be apparent from the detailed description taken with reference to the accompanying drawings.

DETAILED DESCRIPTION OF THE INVENTION

Figure 1:
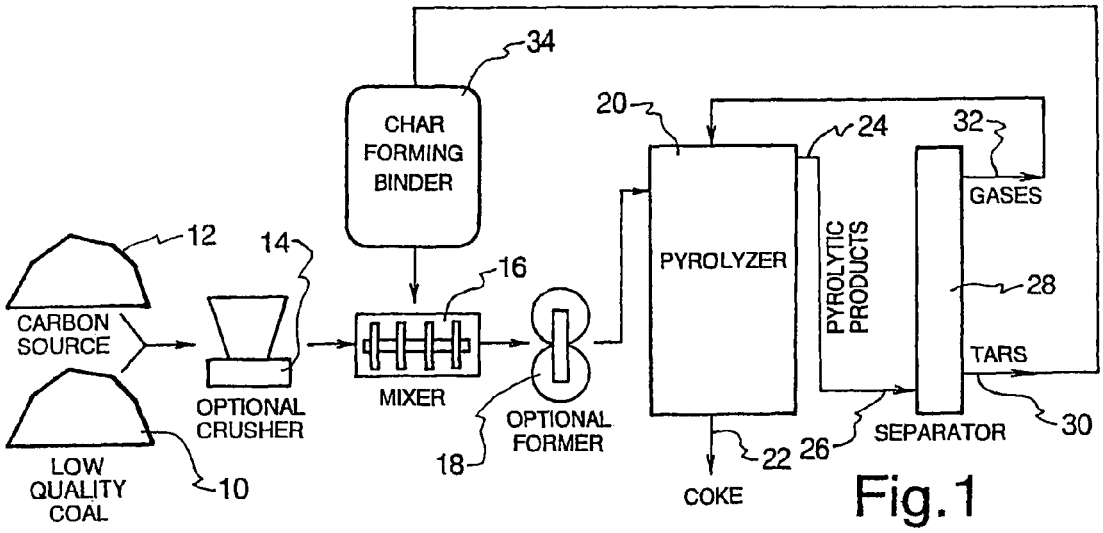
FIG. 1 is a flow diagram of one process by which low-quality coal and another carbonaceous material, such as waste coke fines, are transformed into metallurgical and other grades of coke.

Waste carbonaceous fines have not heretofore been used in the commercial production of coke. Coke is a fuel universally used in the iron and steel industry. Currently, nearly all metallurgical and foundry coke is produced in conventional coke oven facilities requiring the use of good-quality coking coals. These coals are becoming scarce, difficult to mine and, therefore, expensive. Because of the high costs, decreasing supply of these feedstock materials, and environmental contamination problems associated with current coke-making practices, there is a need for alternative coke-making and coke supplementing technologies. Prior attempts to use various form coke processes have primarily resulted in commercial failure and, furthermore, excess by-products of pyrolysis are generated in such processes, which must be refined into salable liquid fuels. Elimination of the need to process and market excess aromatic tars from form coke processes has been a problem. The present invention addresses these problems and provides processes by which waste coke fines (including coke breeze generated from conventional coking processes or petroleum coke) with coal fines are blended to produce a high-quality coke product.

These coke processes do not require high-quality coking coals nor are a surplus of pyrolytic products produced. Non-coking coal fines and coke fines may be blended together in such proportions that production of pyrolysis by-products is limited to the amount required for binding and for process heat. Feedback tar may be combined with additional synthetic or natural binder to produce prime-quality solid coke pieces or objects, such as briquettes or blocks. The process 1) uses feedstock material more efficiently than other form coke processes by eliminating discharge of secondary, low-value by-products, and 2) uses undesirable materials and industrial wastes not heretofore used to produce coke (i.e., low-quality coal and/or coke or char fines) as a feedstock, which represent a current serious environmental problem.

Energy savings for a steel plant can be exemplified by assuming a typical coke fines waste rate of 10% of the total coke production. Energy savings are noted in the increased utilization of raw materials, including extraction, transportation, and differences in processing requirements. Based on a steel mill capacity of about 6,000 tons of hot metal (THM)/day, this represents an energy savings of about $4.5\times10^{11}$ kJ/year over current technology.

Capital costs for the briquetting or solid objects portion of the process have been estimated based on other similar briquetting operations at between \$20-30 million for a one-half million ton/year plant. Raw material costs are estimated to be in the range of $10/ton for waste coal fines and $20/ton for coke fines. The processing costs for briquetting or formation of solid objects, which include the price of the additional natural or synthetic binder, if used, are estimated to be around $18/ton, depending on the type of binder. Total costs for coke production from the process are expected to be in the range of $50-60/ton. Current metallurgical coke prices are in the range of $100-120/ton and foundry coke is $140-160/ton. For a steel plant producing 6,000 THM/day, at an approximate rate of 500 lbs. coke/THM, by incorporating the proposed process, a net savings of $3.3 to $2.8 million/year is expected.

The ability to utilize this new coke product, as a partial coke replacement in the blast furnace, will ultimately be proven by such an application. The properties of coke produced using the present invention compare well with other cokes previously or currently used as blast furnace fuels.

One concern regarding the use of form coke, made from a previous process, in a blast furnace is that its reactivity tended to be higher than standard metallurgical coke produced in slot ovens. The new coke produced according to the present invention is expected to be able to replace oven coke and have reactivities and strengths as good as or better than standard metallurgical coke.

As stated above, coke is a universal fuel used in the iron and steel industry. Metallurgical coke is commonly required for operation of iron ore reduction facilities, such as blast furnaces. Foundry coke is required for scrap melting in cupolas and in casting operations. Coke is also an important fuel for other applications, such as the phosphate industry.

The American steel industry underwent a major restructuring during the 1980's, resulting in the closing of many steel and coke-making plants. From 1980 to 1990, approximately 40% of the United States coke-making capacity was shut down. During this same time, very few new coke-making facilities were built. Today, approximately 26 million tons of metallurgical coke and 2 million tons of foundry coke are produced annually in the United States. Many of the remaining coking facilities are approaching the end of, or have been extended beyond, their life expectancies. Nearly 50% of the current capacity is over 20 years old and 40% is over 30 years old. These older facilities are not only expensive to maintain and operate but they are difficult to keep in compliance with environmental regulations.

Nearly all metallurgical and foundry coke is produced in conventional coke oven facilities requiring the use of high-quality coking coals. Prime coking coals tend to have a volatile content between 19-33%. These coals are becoming scarce, difficult to mine and, therefore, expensive. In 1995, the average delivered price for metallurgical coking coals in the U.S. was over $47/ton, while steam coals were about $27/ton.

Coke ovens have for some time been of serious environmental concern due to the release of particulate and sulfur gases, as well as emissions of carcinogenic and mutagenic polycyclic aromatic hydrocarbons (PAHs) and benzene-toluene-xylenes (BTX). Consequently, the coke-manufacturing industry is being subjected to increasingly stringent environmental regulations. Advances in coke oven design, such as non-recovery ovens and jumbo coking reactors, show some environmental advantages but still require expensive coking coals to operate and represent a very large capital investment. As environmental regulations become more stringent, existing coking facilities will continue to be closed and capacity reduced. Furthermore, the high capital cost of building new coke-making plants based on current technology and dwindling supplies of domestic prime coking coals has caused U.S. companies to look outside the country for coke supplies. The United States already imports a sizable quantity of coke, some produced from its own exported metallurgical coals, because of the high costs, decreasing supply of feedstock materials, and environmental problems associated with current coke-making and coke supplementing technologies.

An alternative to producing coke from metallurgical coals in conventional slot ovens is to use various form coke processes. "Form coke" is a term that generally describes carbonized, briquetted or otherwise formed fuel, made from pyrolyzed coal chars. In a process known as the FMC process, the coal is crushed and then charred at temperatures between 600 and 800° C., then mixed with a binder, briquetted, and finally carbonized at 900-1000° C. The initial partial devolatilization is designed to prevent swelling or sticking of the briquettes during the high-temperature treatment. The binders needed for this briquetting are usually obtained from the combined by-products and tars generated during the low- and high-temperature charring and carbonizing steps. Most form coke processes can utilize non-coking coals for a portion of the feedstock, combined with expensive coking coals.

Numerous form coke processes have been unsatisfactorily experimentally tested. Only a few have reached commercial production. Exceptions are the above-mentioned FMC Process, which converts sub-bituminous coal into pillow-shaped coke briquettes for phosphate production and, also, a process known as the CTC process, which was commercially discontinued recently.

The FMC process requires multiple, staged, fluid-bed heaters to char and carbonize the coal. The tars are captured and used as a binder to form the char into briquettes, which are calcined in a shaft furnace. The process incurs high capital costs.

The now discontinued CTC process used gasification to char the feed coal. The char was then crushed, hot-briquetted and finally calcined. By-products had to be refined into salable liquid fuels in order for the CTC process to be economically feasible. The CTC process utilized high-grade coking coals for a portion of its feedstock.

By contrast, the present processes pertain to making briquettes from waste coke fines rather than coal char. A supplemental binder system, if used, may include combining a natural or synthetic binder with a carbonaceous binder such as tar including, but not limited to, feedback tar from within the system. Extensive development and testing of the waste coke fines briquettes has been performed. Indications are that waste coke fines briquettes formed using the present invention compare favorably with other successful form cokes, such as those obtained from the FMC and CTC processes. See Table 1, below:

TABLE 1

Comparison of Briquettes From Proposed Process With Other Successful Form Cokes

| Form Coke Type | Apparent Specific Gravity | Abrasion Resistance | CSR | CRI |
|---|---|---|---|---|
| FMC[1] | 0.8 | 69 | 47 | 75 |
| CTC[2] | 1.2 | 54 | 30 | 15 |
| New Process[3] | 1.4 | 80 | 50-70 | 15-30 |

[1]Measured from samples obtained from FMC.
[2]Data taken from Young and Musich, 1995.
[3]Typical values measured from briquettes made using the present invention.

The economics of the present coke fines process is improved by: (1) use of feedback tar, resulting in the elimination of the need to import the tar portion of the binder and/or (2) elimination of the requirement to process and sell excess low-value tars. In order to do this, the present invention contemplates blending coke fines (e.g., coke breeze generated from conventional coking processes or petroleum coke) with waste non-coking coal fines. The coke breeze and/or petroleum coke fines and low-grade coal fines are blended with a binder. The blend may be fed directly into the pyrolyzer or pressed into briquettes or other solid forms and subsequently cured. The relative mixture of coke fines with coal fines can be varied depending on the devolatilization products of the coal to obtain a process with closed material-loops where all of the products of devolatilization are used within the process.

During the pyrolysis operation, the temperature of the formed feedstock is elevated at a rate approximately within the range of 1500-2000° C./hour to a maximum temperature within the range of 800-1100° C. The devolatilization behavior of the feedstock varies during heat-up, depending on the feedstock mixture, but gases and tar evolve, leaving a carbon matrix behind.

Devolatilization behavior depends on many factors such as peak temperature, heating rate, particle size and coal type. General trends are that occluded carbon dioxide and methane are driven off at about 200° C. Above this temperature, internal condensation occurs among the macromolecular structures with the evolution of carbon dioxide and water.

In the range of 200-500° C., methane begins to evolve with its higher homologues and olefin. Most of the oxygen in coal structures is eliminated as water and oxides of carbon. The decomposition of both nitrogen structures and organic sulfur species begins in this temperature range.

The evolution of hydrogen begins at 400-500° C. with a critical point at about 700° C. characterized by a rapid evolution of hydrogen and carbon monoxide.

In the temperature range of 500-700° C., the volume of gases, such as hydrogen, carbon monoxide, methane, and nitrogen, increase with increasing temperature, while most hydrocarbons decrease.

Tar formation begins at around 300-400° C., with a maximum yield occurring at approximately 500-550° C., depending on heating rate and particle size. The character and composition of the tars will vary with temperature. Low-temperature tar usually consists mainly of olefin, paraffin hydrocarbons, and cyclic hydroaromatic structures. The aromatic nature of tar increases with increasing temperature until high-temperature tars are composed mostly of aromatic hydrocarbons.

The tars that evolve from the coal fines are captured and returned to be used as a binder. Fuel rich gases are used to operate the pyrolysis furnace. The idea of recycling tar to be used as the binder is not unique, standing alone. Many form coke processes utilize this step, among many others. However, since prior form coke processes typically use only raw coal in their feedstock, they lose a significant portion of their initial weight (30-50%) as tars and gases. While a portion of these products can be utilized as a binder and for process heat, the quantity produced using prior processes is generally larger than can be consumed within the facility and, therefore, must be appropriately disposed of or sold to enhance the economic attractiveness of the process. Due to the high cost of processing these by-products and their aromatic nature, they must often be sold as low-quality feedstock materials to refiners at low prices.

The present processes take advantage of the fact that coke is very low in volatile matter (1-2%) and, therefore, produces nearly no pyrolytic products. This process comprises blending coke fines with coal fines in the proper amount to create just enough pyrolytic products required to perpetuate the process.

The mixture of coal/coke fines are cleaned and blended with tar or other fixed carbon-producing binders. The mix may then be formed into appropriate solid shapes. These shapes are then fed to a pyrolyzer, where the temperature is raised to 800-1100° C. to devolatilize the solid objects driving off tars and gases and leaving a strong, high-carbon content coke. The gases and tars are cooled to approximately 300° C., condensing the tars, allowing them to be separated from the fuel-rich gas and collected. The tars are then recycled to be used within the process as a binder, while the gases are oxidized to provide heat to the pyrolyzer. Calculations indicate that with, for example only, a mix of 55% coke fines, 30% bituminous coal fines and 15% binder, the amounts of tars and gases generated are appropriate to operate the process in a closed-loop fashion. Of course, these proportions will vary under control of one skilled in the art, depending on feedstock properties. At a briquette pyrolysis temperature of 900° C., typical product yields for the various constituents are shown in Table 2, below:

TABLE 2

Approximate Product Yields at 900° C. of Constituents in Mix (Ash-Free Basis)

| Constituent | Fixed Carbon | Tars | Gases |
|---|---|---|---|
| Coke | 100 | 0 | 0 |
| Bituminous Coal | 52 | 30 | 18 |
| Tar Binder | 40 | 40 | 20 |

If these components are blended in the mixture fractions given above, then the resulting products are 77% fixed carbon (coke product), 15% tars (used as a binder on a recycle basis), and 8% gas (used to fuel the pyrolyzer). This gas consists of about 25% water and carbon dioxide, leaving about 6% of the total feed as a combustible gas. The heating value of this gas is typical of coke oven gas (about 21,600 kJ/kg). About 1300 kJ of energy in the form of fuel-rich gas is produced per kilogram of uncoked briquettes. The amount of energy required to raise the temperature of the briquettes from ambient to 900° C. is 1100 kJ/kg, assuming a specific heat of coal of 1.26 kJ/kg° K. Therefore, to produce the proper amount of tars required within the process, the attending amount of evolved combustible gas is sufficient to operate a pyrolysis unit at 84% thermal efficiency. The feedstock mix can be adjusted according to pyrolysis product requirements. During the pyrolysis step, the original briquettes typically will lose only about 20-25% of their weight as opposed to 35-50% in prior form coke processes. Thus, briquettes or other solid objects obtained from the present invention have a higher product yield.

In summary, among other advantages, the proposed process: 1) utilizes low-value carbon fines to produce a high-value coke product; and 2) operates with closed material loops so that the sale of low-value, secondary products is not required to enhance its economic viability, a characteristic of prior form coke processes.

Nearly all metallurgical and foundry coke is produced in conventional, by-product recovery, horizontal slot ovens, requiring high-quality coking coals as a raw material. The evolutionary development of conventional coke ovens is approaching its technologic and economic limits. Because of this, several alternative coking processes have been attempted. Some of these are variations of the slot oven-type of systems including the Jewell-Thompson non-recovery coke oven and the Jumbo coking reactor. The goal of these types of slot-oven technologies is to improve the efficiency and environmental friendliness in the production of coke. However, the economics of producing coke using these new technologies is not an improvement over conventional coke ovens. Another disadvantage of the new slot-oven technologies is that they still require prime coking coals as a feedstock, which coking coals are becoming scarce, difficult to mine, and, therefore, expensive.

One type of emerging coking technology, different from the slot oven approach, is form coke processes, discussed briefly above. A wide range of coals have been tested and some of the processes have produced form coke, the strength and reactivity of which are in an acceptable range for blast furnace use. However, strength tends to be at the low end and reactivity at the high end of that which is generally acceptable. These processes are performed in closed systems, making them very environmentally attractive. Their commercialization has been impeded due to economic considerations and product quality.

A typical form coking practice requires that the process be divided into three steps: 1) coal pyrolysis to form a dense char, 2) briquetting of the char with a binder, and 3) curing the resulting briquettes. Simply binding coal fines together and curing the resulting briquettes is not acceptable. The resulting briquettes exhibit considerable mass loss (35-50%), are small, laden with stress cracks, structurally weak, and likely too reactive. Excess by-products, such as coal tars, must be collected and sold to make the process economically feasible. Due to the high cost of processing these by-products and their aromatic nature, they must often be sold as low-quality feedstock materials to refiners at a low price.

The processes of the present invention allow the coal pyrolysis and briquette curing processes to be combined. It does not require coking coals nor does it necessarily produce a surplus of pyrolytic products. Coal fines and coke fines are blended together in such proportions that just the amount of pyrolysis products are produced needed for perpetuating the binding and heating phases. The tar portion of the binder may be supplemented with a synthetic or natural binder, as appropriately determined by those skilled in the art, which produces a prime quality coke briquette or block. Since dense, low reactivity discarded or waste coke fines from conventional coke ovens or petroleum refining operations are used as a portion of the feedstock, product mass loss is significantly reduced, resulting in a strong product, where reactivity is lowered.

While the present processes more efficiently use feedstock material than is true of the prior form coke processes, there is another very significant feature of the present processes. The feedstock used within this process (i.e., coke fines and coal fines) are normally discarded and classified as either wastes or undesirable materials, representing a current environmental problem. Coke breeze produced at existing coking plants cannot per se be utilized within the blast furnace and must either be disposed of or sold at a relatively low cost. Delayed petroleum coke fines and fluid coke are often land-filled. Coal fines are currently either disposed of in slurry ponds or are land-filled. The transformation of these waste materials into a high-value coke is a surprising and valuable step forward.

Tremendous energy resources are normally associated with coal and coke-intensive industries such as mining, iron and steel production, metal castings, and other manufacturing processes. During normal materials handling, significant amounts of fines are generated which, in the best case, can be sold as a low-quality product, but typically are land-filled. This loss of raw material is about 5-15% of the total coal or coke production and represents a significant energy loss. The present processes allow the steel and mining industries to minimize disposal by utilizing heretofore unused, potentially valuable wastes, thus reducing material costs, land-fill charges and other expenses. Energy savings occur as the consumption of raw materials and the generation of land-filled waste is reduced. This innovative technology significantly reduces wastes generated from coking and mining operations and represents a high-end use for petroleum coke fines. Like all effective process-specific recycles, the amount of raw materials input for a given output is reduced.

Energy savings are noted in the increased utilization of raw materials, including extraction, transportation, and differences in processing requirements. Energy savings for a steel plant producing 6,000 THM per day can be exemplified by reasonably assuming a typical coke fines generation rate of 10% of the total coke production. Use of the briquettes represents a more than one-to-one savings in raw materials, since the briquette replaces both the raw material of appropriate size and the feedstocks that would have been discarded since they were too fine. To produce the additional coke required to compensate for the generation of fines that are too small to use, for the plant size described, requires approximately $1.1\times10^{12}$ kJ/year. To convert those fines into a useable coke product using the proposed process requires only about $6.5\times10^{11}$ kJ/year. The resulting energy savings is about $4.5\times10^{11}$ kJ/year. Other similar values could be obtained for the chemical processing, castings, and other coke-consuming industries.

The capital cost of installing a coke works at an iron production facility represents a significant portion (about 40%) of the overall required capital cost. In 1987, the annual investment costs per ton of coke production was $46-$65. The 1987 maintenance and repair costs were estimated at about $2.50-$3.25/ton. The growing emphasis on safeguarding the environment, both the working environment for the operators and the general environment outside the works boundary, is escalating the cost of coke ovens. The cost of the new 2 million ton/year Kaiserstuhl III coke works was about $800 million, including the cost for coke quenching and the by-products plant. The rebuilding of a 900,000 ton/year plant at the Great Lakes Division of National Steel cost in excess of $450 million. It has been argued that the Kaiserstuhl III works represents the highest development potential of slot-type coke ovens and that a radical departure from the classical design is needed to achieve any major reduction in the cost of coke production.

The cost associated with form coke plants can vary according to the process requirements. Capital costs for the 1 million ton/year FMC plant was estimated at $350 million in 1992. Operating costs were very sensitive to raw material costs and were most favorable for western coals priced at $10/ton, where 60% of the coal weight is lost in the process, as by-products. Total costs associated with coke production were stated to be about $63/ton using western coals, $90/ton with midwestern coals, and $107/ton with eastern coking coals. The costs for western and midwestern coals assume a credit for sale of by-products.

Detailed capital and operating costs associated with the present processes remains to be precisely determined. However, some comparisons with other processes can be made. Capital costs for the present briquetting operations have been estimated, based on other similar briquetting operations, at between $20-30 million for a one-half million ton/year plant. Estimates of operating costs for a briquetting plant of this size include raw materials costs and processing costs. Raw materials costs are estimated to be in the range of $10/ton for waste coal fines and $20/ton for coke fines. The processing costs for briquetting, which include the price of an additional natural or synthetic binder, are estimated to be around $18/ton, depending on the type of binder.

An FMC-formed coke plant, as stated above, uses multiple fluidized beds for char production and a curing oven and calciner for coke production. The processing and capital costs associated with commercial use of the present technology are expected to be much lower than for prior form coke processes, since the char production step is eliminated. Total costs for coke production from the present process are likely to be in the range of $50-60/ton, without requiring the sale of by-products. Current metallurgical coke prices are in the range of $100-120/ton and foundry coke is $140-160/ton.

For a steel plant producing 6,000 THM/day, at an approximate rate of 500 lbs. coke/THM and at an approximate cost of $100/ton for coke, the replacement value of the coke normally lost would be about $5.5 million a year. Reduction in the amount purchased, since all the coke is initially used or reclaimed and used, represents another 1% or $0.55 million. With briquette costs expected to be around $50-60/ton, a net savings of $3.3 to $2.8 million/year is expected.

The characteristics of supplemental coke products and cokes made from alternative coking technologies must fall within the strict standards necessary for its intended use. The most stringent requirements for coke are associated with blast furnace use. Metallurgical coke used in blast furnaces must be (1) a fuel to provide heat to meet the endothermic requirements of chemical reactions and melting of the slag and metal, (2) a producer and regenerator of reducing gases for the reduction of iron oxides, and (3) an agent to provide permeability for gas flow and support for furnace burden. Because of the many requirements placed on metallurgical coke, it must meet stringent standards of strength, size and composition. As a fuel and producer of reducing gases, the carbon content should be maximized. As a regenerator of reducing gas, it should have an adequate reactivity to carbon dioxide and water vapor. To provide permeability and burden support, it should be charged in a narrow size range and experience minimal breakdown as it progresses through the blast furnace.

Different iron ore reduction reactions occur within the blast furnace, depending on furnace operation and temperature region. Indirect reduction occurs at relatively low temperatures (850-900° C.) in the stack. This exothermic reaction can occur with carbon monoxide as follows:

$$3Fe_2O_3(s)+CO \rightarrow 2Fe_3O_4+CO_2 \quad (1)$$

$$Fe_3O4(s)+CO \rightarrow 3(FeO)+CO_2 \quad (2)$$

and $$FeO(s)+CO \rightarrow Fe+CO_2 \quad (3)$$

The "solution loss" reaction produces carbon monoxide from carbon dioxide reacting with coke above 900° C. It is highly endothermic or energy consuming.

$$C(s)+CO_2 \rightarrow 2CO \quad (4)$$

At high temperatures in the lower part of the furnace, iron and carbon monoxide are produced by carbon reacting endothermically with iron oxide by the direct reduction reaction.

$$FeO(s)+C(s) \rightarrow Fe+CO \quad (5)$$

Decreasing direct reduction in favor of indirect reduction is advantageous because the latter is exothermic and lowers the overall heat requirements for the blast furnace. Increasing the CO or $H_2$ content of the blast furnace gas increases the rate of indirect reduction.

Standard testing procedures for cokes to qualify them for use in blast furnaces have been developed over the years, as the science and art of blast furnace operation and the requirements of coke have become better understood. Prior to 1993, standard coke tests included proximate analysis to determine chemical make-up, drop shatter and tumbler tests to determine strength, and specific gravity and porosity tests to measure structural characteristics. None of these tests were performed under conditions that the coke might encounter in the blast furnace, such as a harsh chemical environment, high pressure, and high temperature. In recent years, the Japanese steel industry developed a procedure that tests coke strength and breakdown to $CO_2$ attack under blast furnace conditions. In 1993, this test was adopted as an ASTM standard test for coke as ASTM D 5341-93 entitled Standard Test Method for Measuring Coke Reactivity Index (CRI) and Coke Strength After Reaction (CSR).

The joint CSR/CRI test heats a bed of coke in a nitrogen atmosphere to 1100° C. in 30 minutes, reacts the coke sample in a flow of $CO_2$ for 120 minutes with the bed temperature constant at 1100° C., cools the sample to 100° C., transfers the sample to a tumbler, and tumbles the sample for 600 revolutions in 30 minutes. The sample is then sieved in a ⅜ inch sieve. The CSR is calculated as the remaining portion in the sieve compared to the amount removed from the furnace.

The purpose of the CRI test is to give insight into the ability of $CO_2$ to react with the carbon in the coke, a necessary reaction in the blast furnace but which must be controlled to prevent carbon from being consumed prematurely. The CSR test provides information about two different issues: 1) the strength of the briquettes after reacting with $CO_2$, and 2) the amount of dust produced by $CO_2$ attack and bed agitation. Fine dust can be detrimental in the blast furnace since it can decrease the permeability of the bed requiring increased blast pressure to force the air up through the bed.

Both the FMC and CTC processes described above have demonstrated that they are able to produce form coke capable of blast furnace use. The FMC process utilizes subbituminous coals and lignites, and yields small (1¼×1⅛×¾ inch, or ⅞×¾×½ inch) coke briquettes that have performed well in experimental blast furnace trials. A comparison of FMC-formed coke and a standard metallurgical coke is shown in Table 3 (Berkowitz, 1979) and some data from tests of FMC coke in a U.S. Steel Corporation experimental blast furnace are summarized in Table 4 (Berkowitz, 1979).

TABLE 3

FMC-Formed Coke Properties

| | FMC Coke | "Standard" Metallurgical Coke |
|---|---|---|
| Relative crushing strength, lb/in$^2$ | 3000 | 400-2000 |
| (ASTM) Apparent density, gm/cm$^3$ | 0.8-1.2 | 0.85-1.3 |
| Bulk density, lb/ft$^3$ | 30-45 | 20-30 |
| Hardness, moh scale | 6+ | 6+ |
| Surface area, m$^2$/gm | 50-200 | 1-25 |
| Chemical reactivity, %/hr | 15-50 | 1-5 |
| Volatile matter, % | <3 | 1-2 |

TABLE 4

| Experimental Blast-Furnace Test Data | | |
|---|---|---|
| | FMC Coke | "Standard" 2 × ¾-in Metallurgical Coke |
| Sinter/coke, lb/lb | 2.96 | 2.82 |
| Coke rate, lb/ton hot metal | 1062 | 1096 |
| Production rate, lb/hr | 3601 | 3384 |
| Slag volume, lb/ton hot metal | 604 | 600 |
| Stack dust, lb/hr | 20.2 | 12.7 |

The ability to utilize the present new coke product can be determined by comparing its properties with cokes that have been proven to be effective blast furnace fuels. Table 5 compares some of the advantages of coke fines briquettes produced according to the present invention with other cokes previously or currently used as blast furnace fuels and also lists what is accepted as a standard metallurgical coke (Berkowitz, 1979). While the coke fines/coal fines briquettes may vary somewhat from those produced with coke fines only, the properties will be similar. Testing of briquettes made with coal/coke blends show crush strength values of around 1400 psi.

TABLE 5

| Coke Properties | | | |
|---|---|---|---|
| | FMC Coke | Coke fines Briquettes | "Standard" Metallurgical Coke |
| Relative crushing strength, $lb/in^2$ | 600 | 1400-4000 | 400-2000 |
| Apparent density, $gm/cm^3$ | 0.8-1.2 | 1.2-1.5 | 0.85-1.3 |
| Bulk density, $lb/ft^3$ | 30-45 | na | 20-30 |
| Surface area, $m^2/gm$ | 50-200 | na | 1-25 |
| Relative $CO_2$ reactivity (CRI) | 60-75 | 15-30 | 20-30 |
| Coke Strength (CSR) | 40-50 | 50-75 | 50-65 |

Coals charged to standard coke ovens comprise a blend of coals with differing properties. Typically three to five coals are blended together in such proportions that the properties of the blend will produce a high-quality coke product. If a weakly coking coal of low fusibility is used in the blend, then the strongly coking coal component must be more fusible and higher in volatile matter to compensate. Therefore, even though mildly and weakly coking coals may be used in a particular blend, the blend would be formulated such that its properties would reflect the parameters outlined below in Table 6. Table 6 lists referenced characteristics for high-quality coking coals or blends (Van Krevelen, 1993.) Coal blends not meeting these characteristics would produce inferior coke.

As used in this specification, low-quality coking coals are any coals, individually and collectively, that fall appreciably outside one or more of the parameters listed in Table 6. Although such coals may be included in a blend for standard coke oven use, they do not meet the requirements by themselves. Such coal or coals could be used as the sole source of coal within the new process.

TABLE 6

| Main parameters to characterize coals for carbonization (coking) | | |
|---|---|---|
| Parameter group | Parameters | Indicative values |
| Rank parameters | C-content, daf (%) | 86-90 |
| | H-content, daf (%) | 5.0 to 5.5 |
| | $R_m$ (V-reflectance) | 1.0 to 1.35 |
| | VM-content, daf (%) | 24-28 |
| | CV (MJ/kg), mmmf | 34-36 |
| Rheological parameters (on heating) | FSI | 6.5-8 |
| | Dilation behavior | eu-plastic (ortho-pl. type) dil. 100 to 125% |
| | Maximum fluidity | 900-1100 |
| Parameters for Contaminants | Ash | Less than 7 |
| | S | Less than 0.6 |

Figure 2:
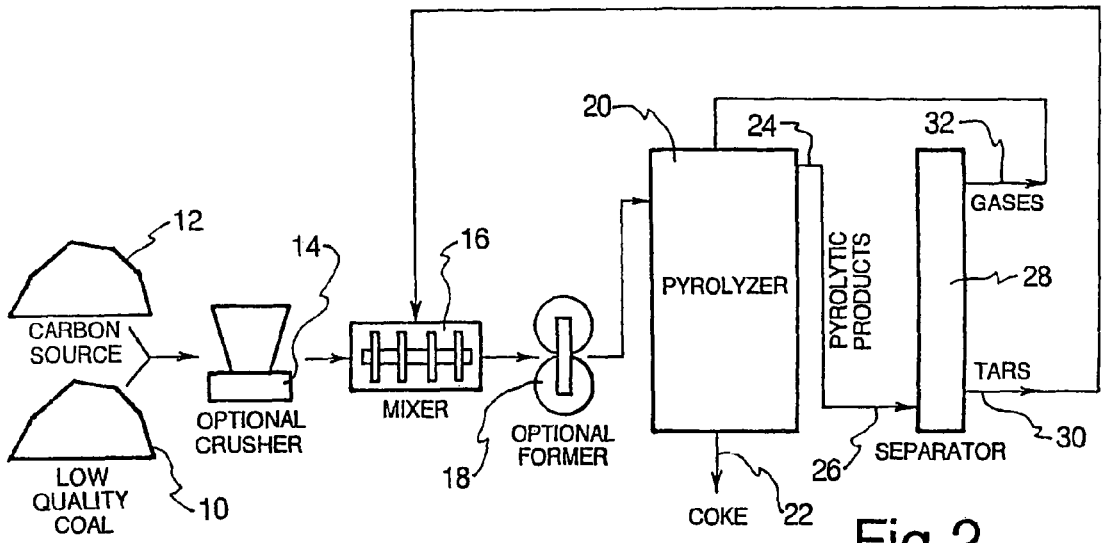
FIG. 2 is a flow diagram of another similar process by which low-quality coal and other carbonaceous material is transformed into metallurgical and other grades of coke.

With reference to the drawings, in light of the foregoing presentation, numerals are used throughout to identify common parts. FIGS. 1 and 2 are flow diagrams of processes by which fine or particulate carbonaceous material, normally considered waste, is transformed into metallurgical and other grades of coke. FIGS. 1 and 2 are identical flow diagrams, except that char-forming binder is not added to the mix in the mixer 16. Accordingly, with this exception, the following description of FIG. 1 applies also to FIG. 2.

Two sources of feedstock are provided, i.e., low-grade coal 10 and discarded or waste coke 12. Any suitable carbonaceous material, such as petroleum coke fines, coke breeze char, or carbon black, may comprise material 12, while coal or waste coal fines may comprise material 10. If unsatisfactorily large in size, the materials 10 and 12 can be crushed to a fine particle size. Material 10 and material 12, if not sufficiently particulate, are, therefore, crushed by a commercially available crusher 14, to obtain suitably sized fine particles. Any suitable crusher may be used, provided, however, in most applications, the crusher must be able to reduce oversized material to about ¼ inch or ⅛ inch and below. The percentages of the various materials being fed to the crusher 14 depend largely on the type of materials being fed. Typically, coal, petroleum coke, and in some cases, metallurgical coke breeze may be fed to the crusher. Coal may account for 20-40% of the mix, petroleum coke may be 40-70%, and metallurgical coke breeze 5-10% of the total mix.

The mixer 16 must be able to adequately combine the carbon fines and the feedback tars and pitches as well as integrate liquid synthetic and/or natural binders, if used. The fines comprising materials 10 and 12, crushed or not crushed as the case may be, are blended in mixer 16 with feedback tars including pitches, obtained during the process (FIG. 2) or feedback tars obtained during the process are mixed with a suitable natural and/or synthetic binder (FIG. 1). Suitable char-forming binders comprises tars, pitches, CAT bottoms and thermosetting resins.

Mixing continues until a desired homogeneous blend of the influent materials is obtained.

The effluent from the mixer 16 may be displaced into a solid object former 18, which may be a briquette machine when solid coke objects or pieces are desired. The former 18 compresses the mixture into a desired shape, e.g., briquettes, blocks, etc. Formation of solid objects or pieces, such as briquettes, is optional, since coke is usable in a variety of forms. The mixture can be discharged from the mixer 16 straight into the pyrolyzer 20, without formation into solid objects. Any suitable type of former may be used depending on the size and shape desired for the final product, as specified by the end user.

The solid objects, such as briquettes from the former 18 or material from the mixer 16, are introduced into a pyrolyzer 20, where the same is coked and prepared for final use. The pyrolyzer furnace 20 must be able to heat the feedstock to around 800-1100° C. at a rate of 1500-2000° C./hour and be able to capture the resulting off-gases and tars. The pyrolyzer 20 normally lowers the coke volatility below 2%. This typically requires temperatures of greater than 800° C., usually within the range of 800-1100° C. Heat-up rate is important to prevent cracking of final product and should be no greater than about 1500° C. per hour. Coke, as solid objects or otherwise, is discharged from the pyrolyzer 20 at site 22.

During the pyrolyzing process, gases and tars evolve as by-products in the pyrolyzer 20. As they evolve, they exit the pyrolyzer at site 24 and become the influent to a separator 28 at site 26. The separator 28 separates the by-product tars from the gases. The tars are discharged at site 30 and fed back as a binder into the mixer 16 at site 34, either with or without the addition of an additional char-forming synthetic and/or natural binder. The gases are discharged at site 32 and fed back as fuel for the pyrolyzer 20. The separator 28 must be able to collect the off-gases and cool, condense and collect the condensed tars.

The exact make-up of feedstock 10 and 12 and parameters can be varied to control the quality of the coke product. Experimental testing has proven that the most stringent coke requirement (i.e., for blast furnace use) can be met.

The present technology's primary objective is to produce fuel for the steel industry's iron production blast furnaces. The finished product can also be used in cupolas in the foundry industry as smokeless fuel, or a general carbon fuel source. The technology provides a less expensive, high-performance product with few, if any, by-product contamination or environmental problems.

The invention may be embodied in other specific forms without departing from the spirit of the central characteristics thereof. The present embodiments, therefore, to be considered in all respects as illustrative and not restrictive, the core of the invention being indicated by the appended claims rather than by the foregoing description, and all changes that come within the meaning and range of equivalency of the claims are, therefore, intended to be embraced therein.

What is claimed is:

1. A method of continuously producing high-grade coke from low-grade material without causing a pollution problem, comprising:

introducing a first mixture of low-grade non-coking, inexpensive coal fines and another type of inexpensive, carbonaceous fines comprised of waste coke fines, as a feedstock influent into a pyrolyzer;

pyrolyzing the displaced mixture in the pyrolyzer to produce a high-grade coke;

discharging said coke and pyrolytic by-products as effluents from the pyrolyzer;

separating tar effluent from said pyrolytic by-products;

continuously introducing mixtures of low grade non-coking inexpensive coal fines and another type of inexpensive, carbonaceous fines comprised of waste coke fines, as a feed stock into said pyrolyzer;

continuously introducing said tar effluent into said pyrolyzer;

wherein quantities of said low-grade non-coking inexpensive coal fines and said another type of inexpensive carbonaceous fines introduced into said pyrolyzer are adjusted such that said tar effluent, produced by a pyrolyzation of said fines does not exceed a quantity of tar effluent required to continuously maintain said production of coke.

2. The method according to claim 1, further comprising:

feeding back tar effluent by-product from the pyrolyzer to the feedstock influent mixture;

feeding back combustible off-gas effluent from the pyrolyzer to the pyrolyzer and using said off-gas effluent as a source of fuel in the pyrolyzer.

3. The method according to claim 1, further comprising separating said combustible off-gas effluent from said pyrolytic by-products and introducing said combustible off-gas-effluent into said pyrolyzer as fuel for said pyrolyzer, wherein quantities of said low-grade non-coking inexpensive coal fines and said another type of inexpensive carbonaceous fines introduced into said pyrolyzer are adjusted such that said combustible off-gas effluent, produced by a pyrolyzation of said fines do not exceed a quantity of combustible off-gas effluent required to continuously maintain said production of coke.

4. The method according to claim 1, further comprising the act of low-grade coal and/or the carbonaceous waste coke prior to the introducing act, to obtain the fines.

5. The method according to claim 1, further comprising the act of forming the mixture into solid objects prior to the introducing act.

6. The method according to claim 4, wherein the discharging act comprises discharging the coke as solid objects.

7. The method according to claim 2, wherein the first feeding act comprises combining the feedback tar, a synthetic binder and the mixture of fines prior to the introducing act.

8. The method according to claim 2, wherein the by-product tar is fed back mixed with another binder additive and combined with the mixture of coal fines and waste coke fines prior to the introducing act.

9. The method according to claim 1, wherein the discharging act comprises cooling the by-products and condensing tar to separate the tar from off-gas.

10. A method of producing coke from a mixture of non-prime coal fines and waste coke fines comprising the acts of:

introducing a mixture of low-grade coal fines and another type of carbonaceous material comprising waste coke fines as a feedstock influent into a pyrolyzer;

pyrolyzing the mixture in the pyrolyzer;

discharging segregated coke and pyrolytic by-products as effluents from the pyrolyzer;

wherein quantities of said low-grade coal fines and said another type of carbonaceous material is adjusted such that said pyrolytic by-products do not exceed a quantity of pyrolytic by-products required to continuously maintain said method.

11. The method according to claim 10, further comprising the acts of:

separating the pyrolytic by-products into tar and combustible off-gas;

combining the separated tar as a binder with the mixture of coal and coke fines in the mixture;

returning the combustible off-gas to the pyrolyzer as a source of fuel.

12. The method according to claim 10, wherein the introducing act further comprises obtaining a mixture comprising waste coke fines and waste coal fines.

13. The method according to claim 10, further comprising the act of crushing at least some of the coke and/or the coal, prior to the introducing act.

14. The method according to claim 10, further comprising the act of forming the mixture into solid objects prior to the introducing act.

15. The method according to claim 14, wherein the discharging act comprises discharging the coke from the pyrolyzer as solid objects.

16. The method according to claim 11, wherein the combining act comprises combining the separated tar, a synthetic binder and the mixture of coal and coke fines prior to the introducing act.

17. The method according to claim 11, wherein the separated tar is fed back to the coal and coke mixture prior to the introducing act.

18. The method according to claim 11, wherein the separating act comprises cooling the by-products to condense tar to separate the tar from off-gas.

19. A method of continuously producing coke from low-grade coal and coke fines, comprising the acts of:

obtaining and mixing low-grade coal fines and coke fines;

introducing the mixture of low grade coal fines and coke fines as an influent into a pyrolyzer;

pyrolyzing the mixture in the pyrolyzer;

discharging segregated coke and pyrolytic by-products comprising combustible off-gas and tar as effluents from the pyrolyzer;

separating the pyrolytic by-products into segregated tar and combustible off-gas;

adding the segregated tar as a binder to the coal and coke fines mixture; and returning the segregated combustible off-gas to the pyrolyzer as a source of fuel;

wherein quantities of said low-grade coal fines and said coke fines is adjusted such that said pyrolytic by-products do not exceed a quantity of pyrolytic by-products required to continuously maintain said method.

20. The method according to claim 19, further comprising the act of crushing oversized waste coke and/or oversized low-grade coal, to correctly size the fines.

21. The method according to claim 19, further comprising the act of forming the mixture into prior solid objects to the introducing act.

22. The method according to claim 21, wherein the discharging act comprises discharging the coke from the pyrolyzer as solid objects.

23. The method according to claim 19, wherein the adding act comprises combining the separated tar, a synthetic binder and the mixture of coal and coke fines prior to the introducing act.

24. The method according to claim 19, wherein the separated tar is fed back to the mixture of coal and coke fines.

25. The method according to claim 19, wherein low-grade coal comprises 20-40% by weight of the coal and coke mixture.

26. The method according to claim 19, wherein the coke fines comprise petroleum coke fines which comprise 40-70% by weight of the coal and coke mixture.

27. A method of producing coke from low-grade coal and coke fines, comprising the acts of:

obtaining and mixing low-grade coal fines and coke fines;

introducing the mixture of lower grade coal fines and waste coke fines as an influent into a pyrolyzer;

pyrolyzing the mixture in the pyrolyzer;

discharging segregated coke and pyrolytic by-products comprising combustible off-gas and tar; as effluents from the pyrolyzer;

separating the pyrolytic by-products into segregated tar and combustible off-gas;

adding the segregated tar as a binder to the coal and coke fines mixture; and returning the segregated combustible off-gas to the pyrolyzer as a source of fuel;

wherein the coke fines comprise coke breeze fines which comprise 5-10% by weight of the coal and coke mixture.

28. The method according to claim 27, wherein said pyrolyzing comprises heating the introduced mixture to a temperature within the range of 800-1100° C. at a rate within the range of 1500-2000° C./hour to lower coke volatility below 2%.

29. The method according to claim 27, wherein the separating act comprises cooling the by-products to about 300° C. and condensing the tar to separate the tar from the off-gas.

30. A method of continuously producing high-quality coke from a mixture of low-grade and/or waste carbonaceous materials at a much lower cost, comprising the acts of:

introducing a mixture of low-grade coal fines and waste coke fines as an influent into a pyrolyzer;

pyrolyzing the mixture of fines in the pyrolyzer; and discharging the coke, and pyrolytic by-products from the pyrolyzer;

wherein quantities of said low-grade coal fines and said waste coke fines is adjusted such that said pyrolytic by-products do not exceed a quantity of by-products required to continuously maintain said method.

31. The method according to claim 30, wherein the by-products comprise tar and combustible gas and further comprising the acts of:

condensing the tar;

using the tar as a binder for the mixture of coal and coke; and using the combustible off-gas as a source of fuel in the pyrolyzer.

32. A continuous method of producing coke from non-traditional carbonaceous materials comprising the acts of:

introducing a mixture of waste coke fines and non-coking grade coal fines as an influent into a pyrolyzer;

pyrolyzing the mixture in the pyrolyzer;

discharging the coke and pyrolytic by-products comprising combustible off-gas and tar as effluents from the pyrolyzer;

reintroducing said tar into said pyrolyzer;

utilizing said combustible off-gas as a fuel to heat said pyrolyzer;

wherein said mixture is formulated such that said pyrolytic by-products do not exceed the quantity of pyrolytic by-products required to maintain said continuous method.

33. The method according to claim 32, comprising the further acts of:

condensing the tar to separate the tar and off-gas;

using the tar as a binder for the mixture fines prior to the mixing act;

using the combustible off-gas as a source of fuel in the pyrolyzer.

34. The method according to claim 33, wherein all condensed tar is utilized as binder and all combustible off-gas is used to fuel the pyrolyzer.

35. The method according to claim 33, wherein the condensed tar is the sole binder source and the combustible off-gas is the sole source of fuel for the pyrolyzer.

36. A method of cost effectively producing high-quality coke from a mixture of non-traditional carbonaceous materials comprising the acts of:

introducing into a pyrolyzer a mixture comprising low-grade coal fines and coke fines as salvage from prior production of coke;

pyrolyzing the mixture and obtaining segregated coke and by-products.

37. A continuous method of producing coke, comprising the acts of:

mixing a binder, low-grade non-prime coal fines selected from the group consisting of waste non-coking coal fines and non-coking coal fines and salvage coke fines selected from the group consisting of waste petroleum fines, waste char fines and waste coke breeze;

introducing the mixture into a pyrolyzer; and pyrolyzing the mixture to derive coke, tar and combustible off-gas;

wherein the mixture is adjusted during mixing such that upon said pyrolyzing of said mixture, an amount of said tar and combustible off-gas derived from said pyrolyzing does not exceed a required amount of said tar and combustible off-gas necessary to maintain said continuous method of producing coke.

38. The method according to claim 37, wherein the method is performed in a closed system and further comprising the acts of:

causing all of the tar to comprise the binder; and fueling the pyrolyzer with the combustible off-gas.

39. A method of continuously producing high-grade coke comprising:

forming a mixture of low-grade non-coking coal fines and waste coke fines, as a feedstock influent into a pyrolyzer;

pyrolyzing the mixture in the pyrolyzer;

discharging coke and pyrolytic by-products as effluents from the pyrolyzer; and introducing said by-products back into said pyrolyzer;

wherein the relative amounts of said coal fines and said waste coke fines are adjusted during the forming of said mixture such that the pyrolytic by-products produced by said pyrolyzing of said mixture are amounts of said by-products required to maintain a continuous operation of said process and said amounts of said by-products do not exceed said amounts required to maintain said continuous operation.

40. The method according to claim 39, wherein said introducing said by-products back into said mixture comprises:

feeding back tar effluent by-product from the pyrolyzer to the feedstock influent mixture.

41. The method according to claim 39, wherein said introducing said by-products back into said pyrolyzer comprises:

feeding back combustible off-gas effluent by-product from the pyrolyzer to the pyrolyzer and using it as a source of fuel in the pyrolyzer.

42. The method according to claim 39, further comprising:

crushing said mixture of low-grade coal fines and said waste coke fines prior to pyrolyzing said mixture.

43. The method according to claim 39, further comprising forming the mixture into solid objects prior to pyrolyzing said mixture.

44. The method of claim 39, said coke is discharged in the form of solid objects.

45. The method according to claim 40, wherein forming said mixture comprises combining the feedback tar, a synthetic binder and the mixture of coal fines and waste coke fines prior to pyrolyzing said mixture.

46. The method according to claim 40, wherein the by-product tar is fed back and mixed with another binder additive and subsequently combined with the mixture of coal fines and waste coke fines prior to the pyrolyzation of said mixture.

47. The method according to claim 39, wherein said discharging of said pyrolytic by-products comprises cooling the by-products and condensing tar to separate the tar from off-gas.

* * * * *